US011644228B2

(12) United States Patent
Ryu et al.

(10) Patent No.: US 11,644,228 B2
(45) Date of Patent: May 9, 2023

(54) ICE MAKING SYSTEM FOR CREATING CLEAR ICE AND ASSOCIATED METHOD

(71) Applicant: Haier US Appliance Solutions, Inc., Wilmington, DE (US)

(72) Inventors: Choon Jae Ryu, Prospect, KY (US); Stephanos Kyriacou, Louisville, KY (US); Ronald Gary Foster, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/580,905

(22) Filed: Jan. 21, 2022

(65) Prior Publication Data

US 2022/0146174 A1 May 12, 2022

Related U.S. Application Data

(62) Division of application No. 16/935,703, filed on Jul. 22, 2020, now Pat. No. 11,326,822.

(51) Int. Cl.

| | |
|---|---|
| ***F25C 1/18*** | (2006.01) |
| ***F25C 1/04*** | (2018.01) |
| ***F25C 1/24*** | (2018.01) |
| ***F25C 5/08*** | (2006.01) |
| ***F25C 5/20*** | (2018.01) |

(52) U.S. Cl.

CPC ..... *F25C 1/18* (2013.01); *F25C 1/04* (2013.01); *F25C 1/24* (2013.01); *F25C 5/08* (2013.01); *F25C 5/22* (2018.01)

(58) Field of Classification Search

CPC ..... F25C 1/18; F25C 1/04; F25C 1/24; F25C 5/08; F25C 5/22

See application file for complete search history.

(56) References Cited

U.S. PATENT DOCUMENTS

| | | | | |
|---|---|---|---|---|
| 6,532,751 | B1 * | 3/2003 | Schenk | F25D 17/065 62/66 |
| 7,318,323 | B2 | 1/2008 | Tatsui | |
| 7,866,167 | B2 | 1/2011 | Kopf | |
| 8,171,744 | B2 | 5/2012 | Watson | |
| 9,175,893 | B2 | 11/2015 | Junge | |
| 9,845,982 | B2 | 12/2017 | Knatt | |
| 10,184,708 | B2 | 1/2019 | Wu | |
| 2006/0272340 | A1 * | 12/2006 | Petrenko | F25C 5/08 62/73 |

(Continued)

FOREIGN PATENT DOCUMENTS

WO WO2006081180 A2 8/2006

*Primary Examiner* — Schyler S Sanks
(74) *Attorney, Agent, or Firm* — Dority & Manning, P.A.

(57) ABSTRACT

An ice making system for creating clear ice and an associated method are provided. The ice making system employs a first sealed refrigerant system connected to a heat exchanger. A second sealed refrigerant system is also connected to the heat exchanger for cooling a first refrigerant of the first sealed refrigerant system. A heat exchanger heater is at least partially contained with the heat exchanger for heating the first refrigerant. A pump in the first refrigerant system is activated after heat exchanger heater has warmed the first refrigerant, enabling a cooling cycle to begin. Once sufficient clear ice has been generated, the pump is deactivated.

20 Claims, 6 Drawing Sheets

(56) References Cited

U.S. PATENT DOCUMENTS

| | | | | |
|---|---|---|---|---|
| 2007/0119193 | A1* | 5/2007 | Davis | F25C 5/046 62/135 |
| 2010/0326093 | A1* | 12/2010 | Watson | F25B 7/00 62/66 |
| 2014/0150460 | A1 | 6/2014 | Boarman | |
| 2018/0156514 | A1* | 6/2018 | Wu | F25B 21/04 |
| 2019/0186801 | A1 | 6/2019 | Kopko | |

* cited by examiner

ICE MAKING SYSTEM FOR CREATING CLEAR ICE AND ASSOCIATED METHOD

CROSS REFERENCE TO RELATED APPLICATIONS

This application is a divisional of and claims the benefit of priority under 35 U.S.C. § 120 to U.S. patent application Ser. No. 16/935,703 filed Jul. 22, 2020, entitled Ice Making System for Creating Clear Ice and Associated Method, incorporated by reference in its entirety herein

FIELD OF THE INVENTION

The present subject matter relates generally to clear ice making systems for appliances, and more particularly, to a dual refrigerant system with various adjustable elements for controlling the cooling capacity of the ice making system.

BACKGROUND OF THE INVENTION

Certain refrigerator appliances include an icemaker. To produce ice, liquid water is directed to the icemaker and frozen. A variety of methods exist for freezing the water. In some systems a glycol refrigerant is used to cool the chamber in which the icemaker resides and a secondary refrigerant system is used to cool the glycol refrigerant.

Such a dual refrigerant system has certain drawbacks. For example, additional components are required for a second refrigerant system, raising overall operating costs. Some systems turn off elements of the refrigerant systems when there is no demand for ice to allay such costs. However, doing so may lead to the complication of glycol freezing in the refrigerant system, making it unable to flow when ice is required. In addition, such dual refrigerant systems have a high cooling capacity, leading to fast formation of ice. In forming ice quickly, impurities are trapped in the ice, leading it to have a cloudy or opaque appearance which may be undesirable to users who generally prefer clear ice.

Accordingly, an ice making assembly for a refrigerator appliance with a heat exchanger heater for warming the glycol refrigerant prior to initiation of a cooling cycle is desirable. In addition, an ice making assembly for a refrigerator appliance with features for controlling the cooling capacity of the ice making system would also be useful.

BRIEF DESCRIPTION OF THE INVENTION

Aspects and advantages of the invention will be set forth in part in the following description, or may be apparent from the description, or may be learned through practice of the invention.

In a first example embodiment, an ice making assembly for generating clear ice is provided. The ice making assembly includes an ice holding chamber, a water distribution manifold for providing water to the ice making assembly from a domestic supply, a mold body, a heat exchanger, a first sealed refrigerant system, a second sealed refrigerant system, and a heat exchanger heater. The mold body defines a plurality of ice cavities and is in fluid communication with the water distribution manifold. The heat exchanger has a first inlet in fluid communication with a first outlet and a second inlet in fluid communication with a second outlet. The first sealed refrigerant system includes a pump for cyclically circulating a first refrigerant through a refrigerant manifold. The refrigerant manifold is connected to the first inlet of the heat exchanger and the first outlet of the heat exchanger. At least a portion of the refrigerant manifold is adjacent to the ice holding chamber for removing heat from the ice holding chamber. The second sealed refrigerant system cyclically circulates a second refrigerant through a compressor, the second inlet of the heat exchanger, and the second outlet of the heat exchanger for removing heat from the first refrigerant. The heat exchanger heater is at least partially contained with the heat exchanger for providing heat to the first refrigerant.

In a second example embodiment, a method of making clear ice is provided. The method includes detecting a demand for ice, activating a heat exchanger heater for heating a first refrigerant, and monitoring heat exchanger heater usage data. The method also includes activating a pump based on the heat exchanger heater usage data, such that the pump circulates the first refrigerant through a first sealed refrigerant system to remove heat from an ice holding chamber. The method further includes delivering water to a mold body from a water distribution manifold, detecting that demand for ice is satisfied, and deactivating the pump.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
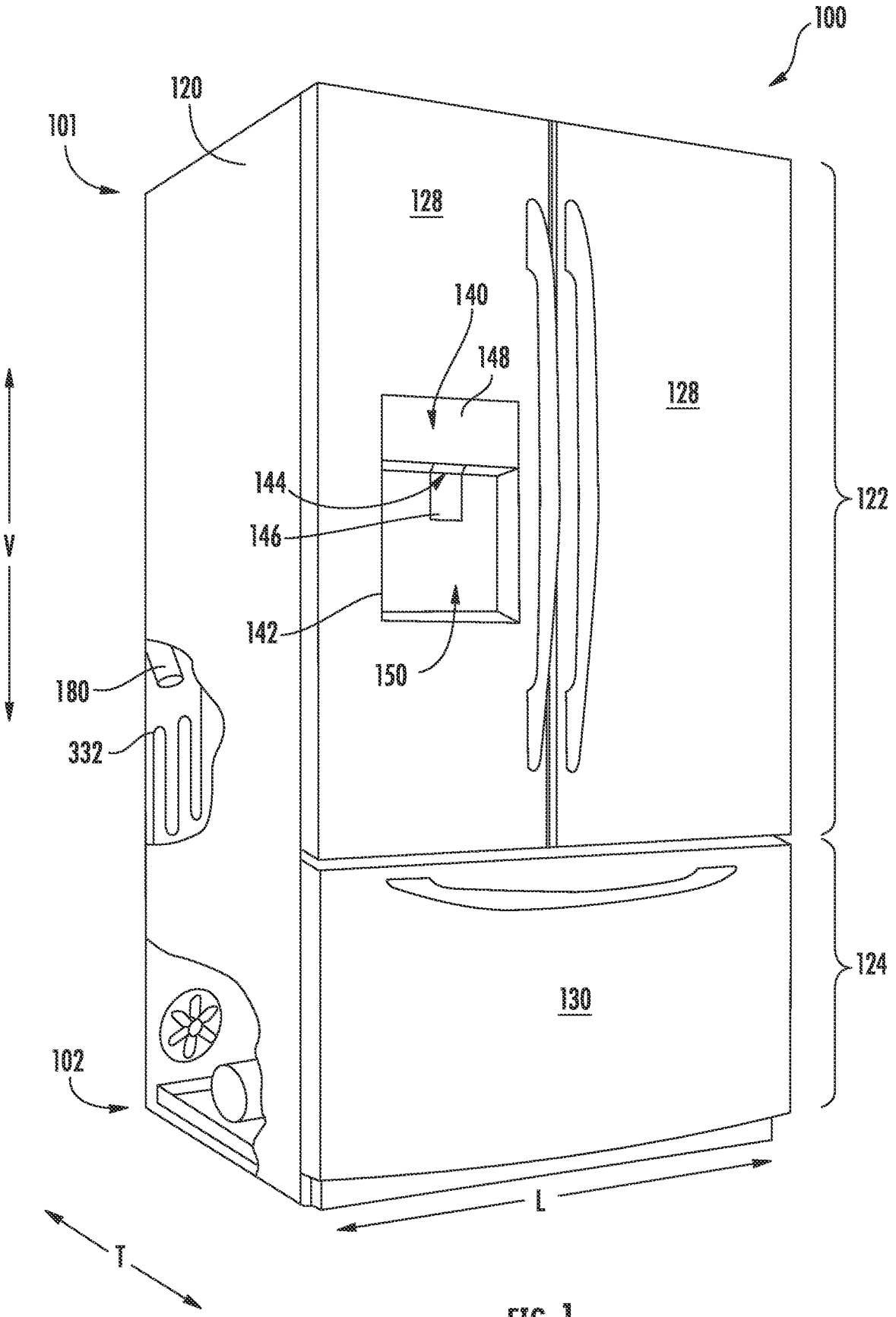
FIG. 1 provides a perspective view of a refrigerator appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 100 according to an exemplary embodiment of the present subject matter. Refrigerator appliance 100 includes a cabinet or housing 120 that extends between a top portion 101 and a bottom portion 102 along a vertical direction V.

Housing 120 defines chilled chambers for receipt of food items for storage. In particular, housing 120 defines a fresh food chamber 122 positioned at or adjacent top portion 101 of housing 120 and a freezer chamber 124 arranged at or adjacent bottom portion 102 of housing 120. As such, refrigerator appliance 100 is generally referred to as a "bottom mount refrigerator." It is recognized, however, that the benefits of the present disclosure apply to other types and styles of refrigerator appliances such as, e.g., a top mount refrigerator appliance or a side-by-side style refrigerator appliance, as well as stand-alone ice makers. Consequently, the description set forth herein is for illustrative purposes only and is not intended to be limiting in any aspect to any particular appliance or chilled chamber configuration.

Refrigerator doors 128 are rotatably hinged to an edge of housing 120 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in a closed configuration in FIG. 1.

Refrigerator appliance 100 also includes a dispensing assembly 140 for dispensing liquid water and/or ice. Dispensing assembly 140 includes a dispenser 142 positioned on or mounted to an exterior portion of refrigerator appliance 100, e.g., on one of doors 128. Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open doors 128. In the exemplary embodiment, dispenser recess 150 is positioned at a level that approximates the chest level of a user.

Figure 2:
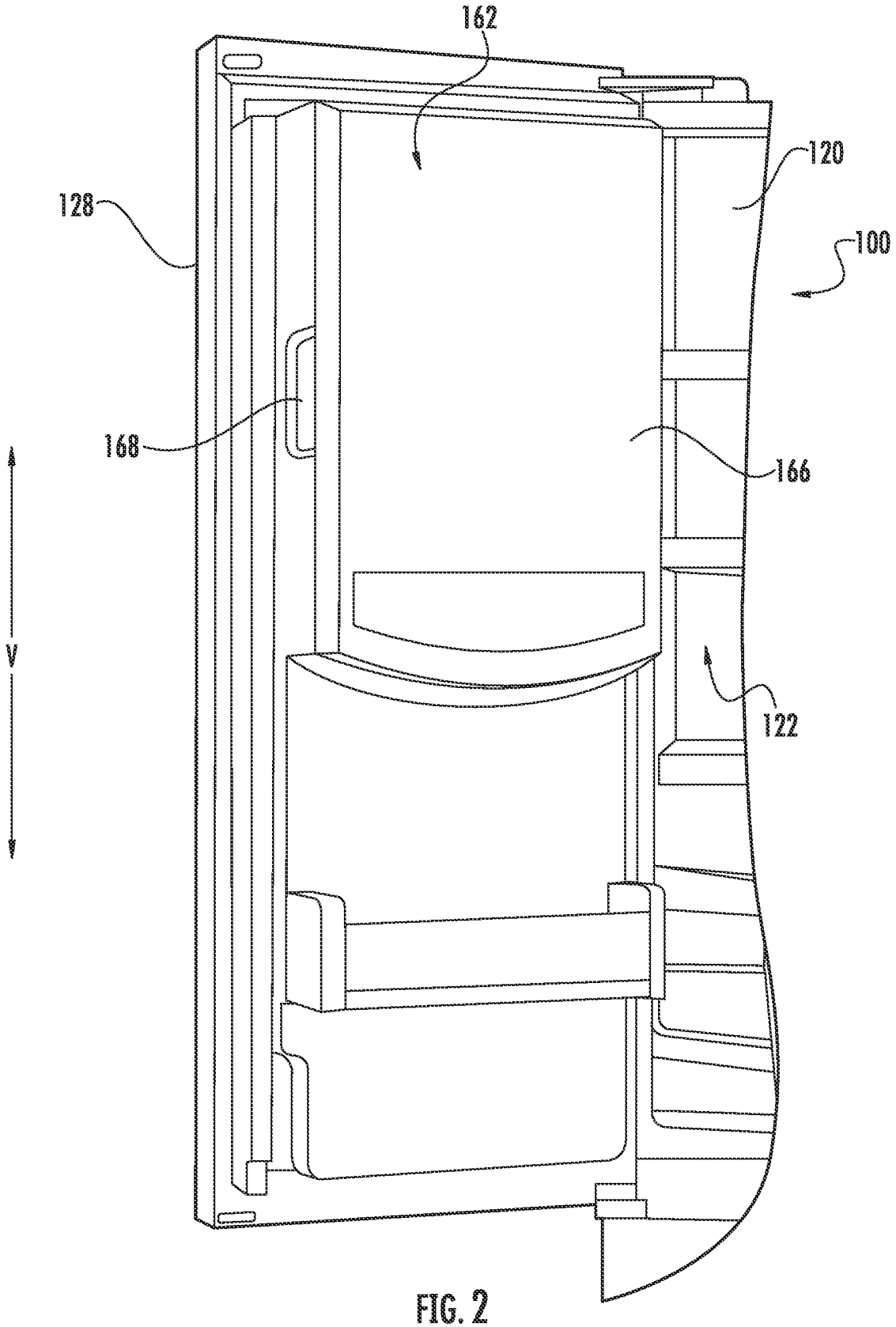
FIG. 2 provides a perspective view of a door of the exemplary refrigerator appliance of FIG. 1.
Figure 3:
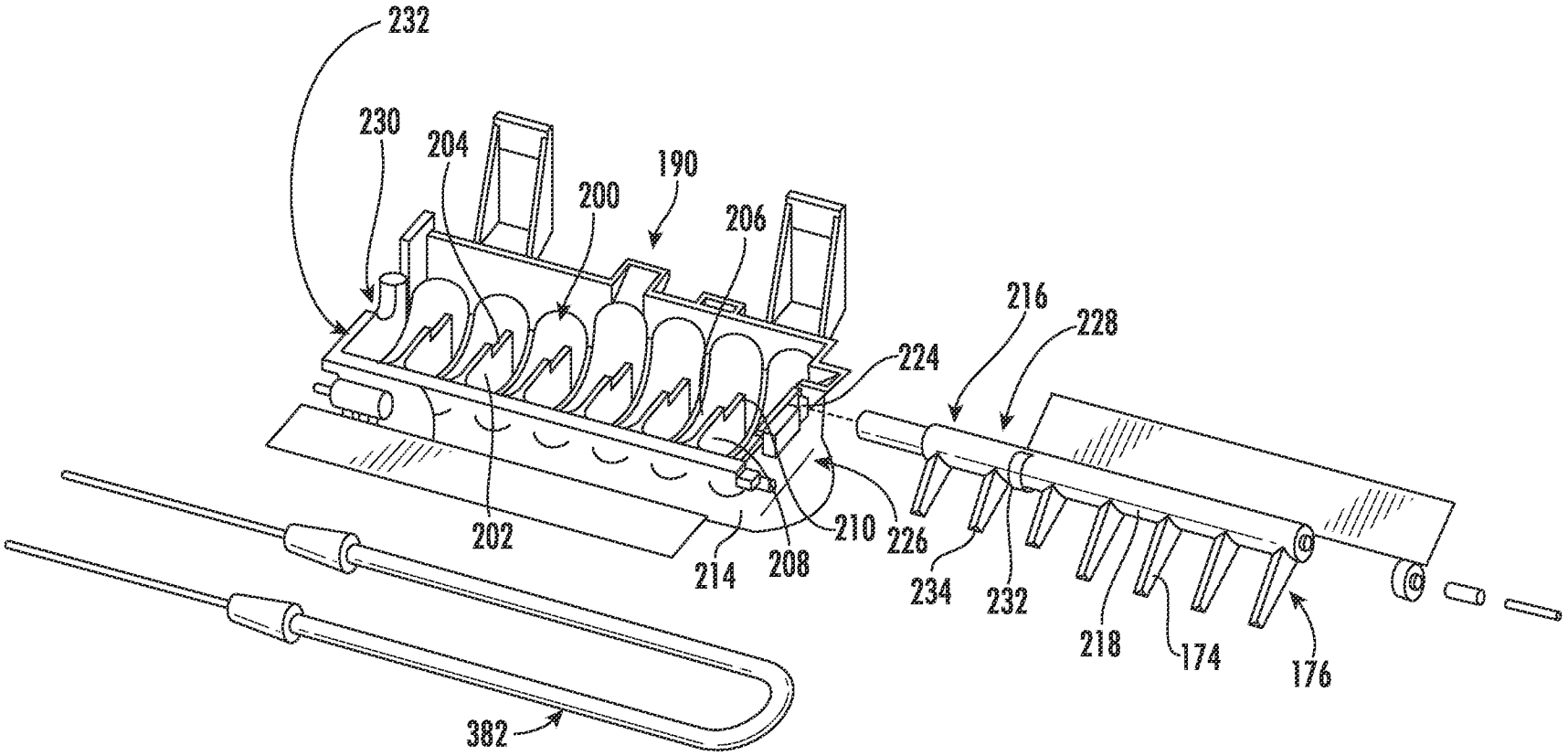
FIG. 3 provides an exploded perspective view of an ice making assembly in accordance with certain aspects of the present disclosure.

FIG. 2 provides a perspective view of a door of refrigerator doors 128. FIG. 3 provides a partial, elevation view of refrigerator door 128 with an access door 166 shown in an open position. Refrigerator appliance 100 includes a sub-compartment 162 defined on refrigerator door 128. Sub-compartment 162 is often referred to as an "icebox." Sub-compartment 162 is positioned on refrigerator door 128 at or adjacent fresh food chamber 122. Thus, sub-compartment 162 may extend into fresh food chamber 122 when refrigerator door 128 is in the closed position. Access door 166 is hinged to refrigerator door 128. Access door 166 permits selective access to sub-compartment 162. Any manner of suitable latch 168 is configured with sub-compartment 162 to maintain access door 166 in a closed position. As an example, latch 168 may be actuated by a consumer in order to open access door 166 for providing access into sub-compartment 162. Access door 166 can also assist with insulating sub-compartment 162.

As may be seen in FIG. 3, refrigerator appliance 100 includes an icemaker or ice making assembly 160. It will be understood that while described in the context of refrigerator appliance 100, ice making assembly 160 can be used in any suitable refrigerator appliance or as a stand-alone icemaker. Thus, e.g., in alternative exemplary embodiments, ice making assembly 160 may be positioned at and mounted to other portions of housing 120, such as within various ice holding chambers including freezer chamber 124 or sub-compartment 162 or may be fixed to a wall of housing 120 within fresh food chamber 122 rather than on refrigerator door 128.

In FIG. 3, ice making assembly 160 is positioned or disposed within sub-compartment 162. Thus, ice is supplied to dispenser recess 150 (FIG. 1) from the ice making assembly 160. Chilled air generated by passing air from a sealed system (not pictured) across a refrigerant manifold 366 (FIG. 4) of refrigerator appliance 100, as discussed in greater detail below, may be directed into ice making assembly 160 in order to cool components of ice making assembly 160. In particular, an evaporator 332, e.g., positioned at or within fresh food chamber 122 or freezer chamber 124, is configured for generating cooled or chilled air for the fresh food chamber 122 and/or freezer chamber 124. A supply conduit 180, e.g., defined by or positioned within housing 120, extends between evaporator 332 and components of ice making assembly 160 in order to cool components of ice making assembly 160 and assist ice formation by ice making assembly 160. In alternative embodiments, ice making assembly 160 may employ a direct cooling system. A first sealed refrigerant system 360 may be circulated through a refrigerant manifold 366 (FIG. 4), as further described herein. Refrigerant manifold may be integrated into or be situated in close proximity to a mold body 200 of ice making assembly 160, thereby effecting a direct transfer of heat from mold body 200 to a refrigerant of first sealed refrigerant system 360.

As illustrated in FIG. 3, ice making assembly 160 in accordance with an embodiment of the present disclosure is illustrated. The ice making assembly 160 comprises a body or ice tray 190 including mold body 200 for receiving water and freezing the water to ice. As shown, the ice tray 102 includes seven substantially identical ice forming compartments; although, it should be appreciated that more or less than seven ice forming compartments can be provided. It should also be appreciated that while one exemplary type of ice maker is illustrated (a so-called crescent cube variety of ice maker), any suitable ice maker including a twist tray type, can be utilized in connection with the present disclosure. In the illustrated embodiment, each compartment of mold body 200 includes a first side surface 202, a second side surface 204, and an arcuate bottom surface 206 interposed between first side surface 202 and second side surface 204. Partition walls 208 are disposed between each of the compartments, the partitions walls at least partially defining first side surface 202 and second side surface 204. The partition walls 208 extend transversely across the ice tray 190 to define the ice forming compartments in which ice pieces (not shown) are formed. Each partition wall 208 includes a recessed upper edge portion 210 through which water flows successively through each compartment of mold body 200 to fill the ice tray 190 with water. A water filling operation of ice tray 190 may be based on a set time.

Figure 6:
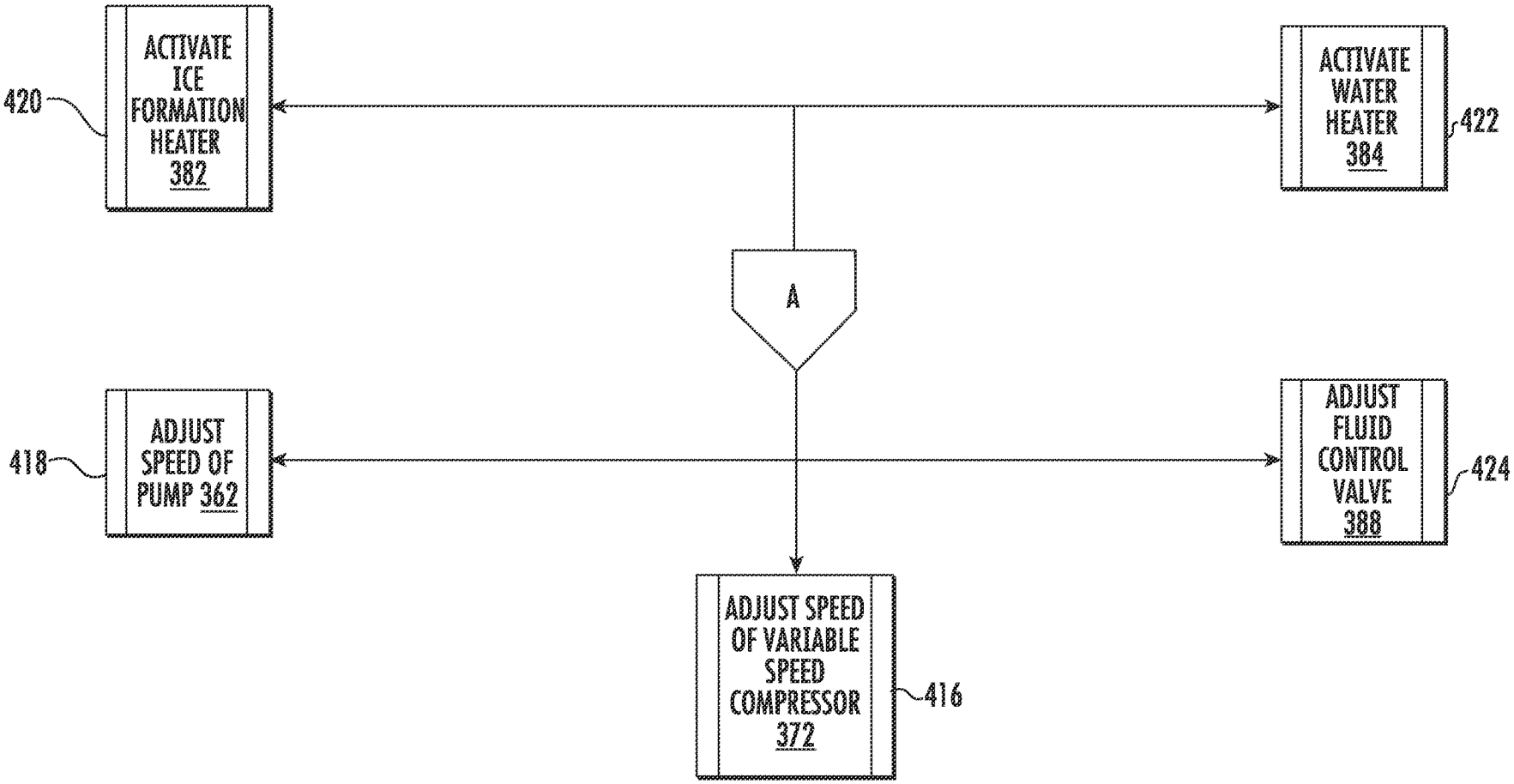
FIG. 6 provides a flow chart of further steps in an exemplary method in accordance with the present subject matter.

Water is provided to compartments of mold body 200 through a channel or water distribution manifold 240 (FIG. 6). Water distribution manifold 240 may include one or more outlets (not pictured). Liquid water within water distribution manifold 240 can flow out of outlets to introduce water to the compartments of mold body 200. Due to chilled air within chilled air duct (not pictured), water is chilled to or below the freezing temperature of water such that liquid water flowing within compartments of mold body 200 can freeze and form ice cubes.

As shown in FIG. 3, a sheathed electrical resistance heating element or ice formation heater 382 (further detailed below) is mounted to a lower portion 214 of the ice tray 190. The heater can be press-fit, stacked, and/or clamped into lower portion 214 of ice tray 190. Ice formation heater 382 is configured to heat mold body 200 when a harvest cycle is executed to slightly melt the ice and release the ice from the compartments of mold body 200.

An ice ejector or rake 216 is rotatably connected to ice tray 190. Ice ejector 216 includes an axle or shaft 218 and a plurality of ejector members 220 located in a common plane tangent to axle 218, one ejector member 220 for each compartment of mold body 200. Axle 218 is concentric about the longitudinal axis of rotation of ice ejector 216. To rotatably mount ice ejector 216 to ice tray 190, a first end section 222 of ice ejector 216 is positioned adjacent an opening 224 located at a first end portion 226 of ice tray 190. A second end section 228 of ice ejector 190 is positioned in an arcuate recess 230 located on a second end portion 232 of ice tray 190. In the illustrated embodiment, ejector members 220 are triangular shaped projections 234 and are configured to extend from axle 218 into the compartments of mold body 200 when ice ejector 216 is rotated. It is within the scope of the present disclosure for ejector members 220 to be fingers, shafts, or other structures extending radially beyond the outer walls of axle 218. Ice ejector 2216 is rotatable relative to ice tray 214 from a closed first position to a second ice harvesting position and back to the closed position. Rotation of ice ejector 216 causes ejector members 220 to advance into the compartments of mold body 200 whereby ice located in each compartment is urged in an ejection path of movement out of the ice forming compartment.

Figure 4:
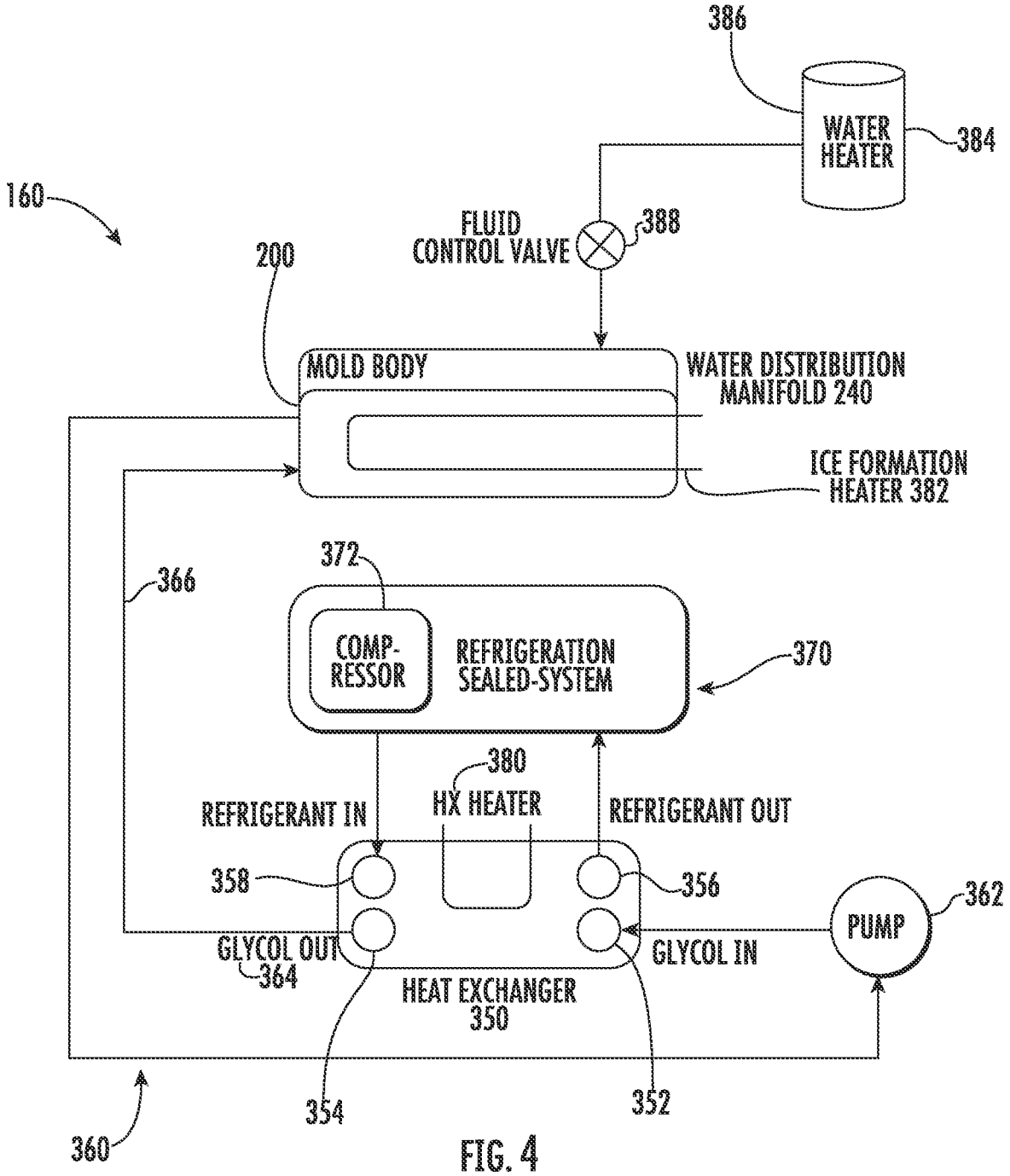
FIG. 4 provides schematic view of an exemplary ice making system in accordance with the present subject matter.

FIG. 4 provides a schematic view of certain components of an embodiment of ice making assembly 160. The ice making assembly 160 of FIG. 4 includes a heat exchanger 350. Heat exchanger 350 may include a first inlet 352 in fluid communication with a first outlet 354 and a second inlet 356 in fluid communication with second outlet 358. Ice making assembly 160 may employ a first sealed refrigerant system 360 for facilitating the freezing of ice in ice cavities 210 in an ice holding chamber such as freezer chamber 124 or ice collector 256. First sealed refrigerant system 360 employs a pump 362 to cyclically circulate a first refrigerant 364 through a refrigerant manifold 366. In the preferred embodiment of FIG. 4, the first refrigerant is glycol, though other common refrigerants may be employed. Refrigerant manifold 366 may be connected to first outlet 354 of heat exchanger 350 and extend through cabinet 120. At least a portion of refrigerant manifold 366 may be adjacent to freezer chamber 124 or ice collector 256, which may contain mold body 200. As previously described, air may be passed across this adjacent portion of refrigerant manifold 366 chilling the air prior to its introduction into the ice collection chamber. As shown in the embodiment of FIG. 4, refrigerant manifold 366 then continues, next connecting to pump 362, and finally connecting to first inlet 352 of heat exchanger 350, completing the first sealed refrigerant system loop. In other embodiments, the configuration of components may differ. For example, pump 362 may be located between first outlet 354 and mold body 200 to achieve the same purpose.

During each cycle of first sealed refrigerant system 360, first refrigerant 364 is heated and must be cooled prior to the next cycle. This may be accomplished by cyclically circulating a second refrigerant 371 in a second sealed refrigerant system 370 through heat exchanger 350. Second sealed refrigerant system 370 cycles second refrigerant 371 from second outlet 356 to a compressor 372, which heats second refrigerant 371 and drives it through second sealed refrigerant system 370. Second refrigerant 371 then passes through a condenser (not pictured), which converts the heated gaseous second refrigerant 371 to a liquid, and an expansion device (not pictured), which cools and reduces the pressure of second refrigerant 371. Second sealed refrigerant system 370 then cycles second refrigerant 371 into second inlet 358 of heat exchanger 350. The cooled second refrigerant 371 of second sealed refrigerant system 370 has a temperature higher than that of first refrigerant 364, enabling heat to transfer from first sealed refrigerant system 360 to second sealed refrigerant system 370.

While the features of ice making assembly 160 described above contribute to the formation of ice in mold body 200 generally, the production of clear ice requires that the cooling capacity of ice making assembly be reduced and controlled to slow the rate of ice formation and to thus remove impurities from the ice. Certain elements described above may be controlled for this purpose. For example, compressor 372 may be a variable speed compressor. During operation of ice making assembly 160, power to variable speed compressor 372 may be reduced, resulting in reduced heat transfer between first sealed refrigerant system 360 and second sealed refrigerant system 370. By controlling the level of power provided to variable speed compressor 372, this rate of heat transfer may be controlled, thus enabling selective warming of first refrigerant 364. A warmer first refrigerant 364 may reduce the amount of heat transfer from water in mold body 200 and thus may slow the rate of ice formation in mold body 200.

Similarly, pump 362 of ice making system 160 may be a variable speed pump. By reducing power to variable speed pump 362, the rate of flow of first refrigerant 364 through refrigerant manifold 366 may be reduced. A reduction in the flow rate of first refrigerant 364 may also reduce the rate of heat transfer from water in mold body 200 and thus slow the rate of ice formation in mold body 200. One or more temperature sensors 390 may be at least partially contained within refrigerant manifold 366 to determine the temperature of first refrigerant 364 at one or more locations in its cycle. This temperature information may be used to determine the power requirements of compressor 372, pump 362, or other control elements addressed below.

Additional control elements may be optionally included in ice making system 160 to slow the rate of ice formation to enable the formation of clear ice. For example, an ice formation heater 382 may be attached to, integral with, or in close proximity to mold body 200. Operation of ice formation heater 382 provides heat to water introduced to mold body 200, again slowing the rate of ice formation. Alternatively, or in addition, the ice formation rate on mold body 200 may be reduced by pre-heating the water provided to mold body 200 by water distribution manifold 240. This may be accomplished by use of a water heater 384 position upstream of mold body 200 and water distribution manifold 240. Water heater 384 may include a water heater outlet 386 connected to a pipe, hose, or other similar means of conveying fluid, which delivers warm water to water distribution manifold 240. Here, warm water should be understood as water at a temperature above 75° F.

Further, ice making system 160 may optionally include a fluid control valve 388 positioned upstream of water distribution manifold 240. To the extent that fluid control valve 388 is employed in combination with water heater 384, fluid control valve 388 may be positioned between water distribution manifold 240 and water heater 384 to control the rate of water flow into mold body 200. By partially closing fluid control valve 388, the flow rate of water to water distribution manifold 240 is reduced, thus reducing the flow rate of water to mold body 200. This, in turn, reduces the rate at which ice is formed, aiding in the formation of clear ice.

Heat exchanger 350 of ice making system 160 may further include a heat exchanger heater 380, as shown in the schematic drawing of FIG. 4. Heat exchanger heater 380 may be at least partially contained within heat exchanger 350 so as to provide heat to first refrigerant 364. This may serve multiple purposes. First, heat exchanger heater 380 may be employed to control the rate of ice formation by heating first refrigerant 364 to reduce the rate of heat transfer from water in mold body 200. Second, when used in combination with one or more of variable speed compressor 372 and/or variable speed pump 362, heat exchanger heater 380 may be employed to ensure that first refrigerant 364 does not freeze or to melt first refrigerant 364 if it does freeze. This may be necessary, in one example, if pump 362 is disabled or receives a reduction of power such that second sealed refrigerant system 370 cools first refrigerant 364 beyond its freezing point. In such circumstances, heat exchanger heater 380 would provide heat to first refrigerant 364 to attain or maintain a temperature above its freezing point. In some embodiments, operation of heat exchanger heater 380 may be at least partially dependent on the output of the temperature sensor or sensors 390. For example, heat exchanger heater 380 may, in some embodiments, only be activated when the temperature of first refrigerant 364 drops below a threshold level above the freezing point to ensure that first refrigerant 364 does not freeze. Of course, other circumstances and inputs, such as activation of pump 362, may also or instead act as triggers to turn on heat exchanger heater 380.

Now that the construction of refrigerator appliance 100 and ice making assembly 160 have been presented according to exemplary embodiments, an exemplary method 400 of making clear ice will be described. Although the discussion below refers to exemplary method 400 of making clear ice by controlling a variety of elements of ice making assembly 160, one skilled in the art will appreciate that each of the steps may be performed individually or in combination with the other method steps described herein.

Figure 5:
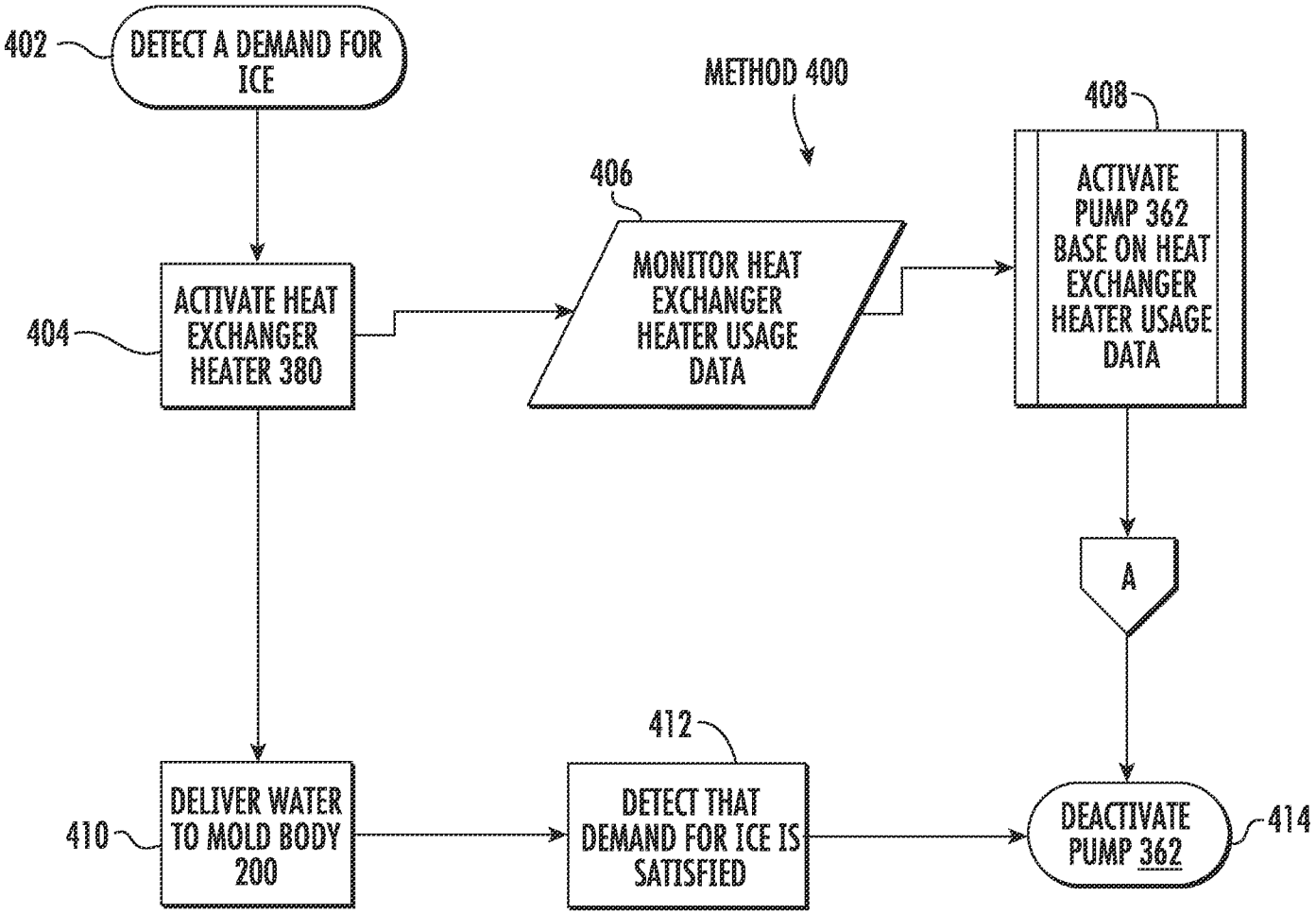
FIG. 5 provides a flow chart of steps in an exemplary method in accordance with the present subject matter.

As shown in FIGS. 5-6, method 400 begins with the step 402 of detecting a demand for ice. This detection step may take the form of an input generated by lowering of a hinged lever bar (not pictured) in ice collector 256. The structure and function of hinged levers are understood by those of ordinary skill in the art and, as such, are not specifically illustrated or described in further detail herein for the sake of brevity and clarity. Hinged lever bar may rest on top of ice collected in ice collector 256. As ice from ice collector 256 is used, the height of the combined ice lowers, causing the hinged lever bar to rotate about its hinge. Detection of this rotation, in a conventional manner, beyond a given threshold triggers an output that is detected by ice making system 160. Alternatively, or in addition, a user interaction with user interface panel 148 may also trigger a detection by ice making system with the scope of this step.

Upon detection of a demand for ice, method 400 then includes step 404 activation of heat exchanger heater 380 to heat first refrigerant 364 as previously described. Following activation of heat exchanger heater 380, the next step 406 is monitoring heat exchanger heater usage data. Heat exchanger heater usage data may include any data relating to operation of heat exchanger heater 380 or its effects. For example, in one embodiment, heat exchanger heater usage data may include the length of time that heat exchanger heater 380 is operational. In another embodiment, heat exchanger heater usage data may include the temperature of first refrigerant 364. Other embodiments may include a combination of this or other heat exchanger heater usage data.

After monitoring heat exchanger heater usage data, the next step 408 is activating pump 362 based on heat exchanger heater usage data. For example, when heat exchanger heater usage data is the length of time that heat exchanger heater 380 is operation, pump 362 is activated upon the expiration of a fixed length of time. That fixed length of time is determined based on how long heat exchanger heater 380 requires to melt frozen first refrigerant 364, which may vary depending on the type of refrigerant used and the physical arrangement of elements in ice making system 160. For embodiments in which heat exchanger heater usage data is the temperature of first refrigerant 364, pump 362 is activated upon first refrigerant 364 reaching a temperature appropriate for the desired cooling capacity of ice making system 160.

Method 400 may further include the step 410 of delivering water to mold body 200 in the ice holding chamber (e.g., freezer chamber 124 or ice collector 256) from water distribution manifold 240. The water introduced to mold body 200 transfers heat to first refrigerant 364 as previously described, thus enabling the formation of clear ice under the controls set forth herein. Following the formation of additional clear ice, the next step 412 in method 400 is detecting that demand for ice is satisfied. This detection step may take the form of an input generated by lifting of a hinged lever bar (not pictured) in ice collector 256. Once enough ice has accumulated in ice collector 256, the height of the combined ice raises causing hinged lever bar to rotate about its hinge. Detection of this rotation, in a conventional manner, beyond a given threshold triggers an output that is detected by ice making system 160. Based on that output, pump 362 is deactivated in step 414, preventing further flow of first refrigerant 364 through refrigerant manifold 366.

In some embodiments, such as that shown in FIG. 6, method 400 may further include step 416 of adjusting the speed of variable speed compressor 372. As previously described, compressor 372 drives refrigerant through second sealed refrigerant system 370, enabling heat transfer from first sealed refrigerant system 360. By adjusting the power delivered to variable speed compressor 372, the speed of compressor 372 may be controlled. By adjusting the speed of compressor 372, the rate of heat transfer from in first sealed refrigerant system 360 to second sealed refrigerant system 370 may be raised or lowered to achieve a desired cooling capacity for ice making system 160 as first sealed refrigerant system 360 passes in proximity to second sealed refrigerant system 370 as they circulate first refrigerant 364 and second refrigerant 371 through heat exchanger 350.

In the alternative, or in addition, method 400 may also include the step 418 of adjusting the speed of pump 362 following its activation. The speed of pump 362 may be adjusted by adjusting the power delivered to pump 362. Raising the power delivered to pump 362 raises the speed of pump 362, increasing the flow rate of first refrigerant 364 through refrigerant manifold 366 and increasing the cooling capacity of ice making system 160. In contrast, lowering the power delivered to pump 362 lowers the speed of pump 362, decreasing the flow rate of first refrigerant 365 through refrigerant manifold 366 and decreasing the cooling capacity of ice making system 160.

Other embodiments of method 400 may limit the cooling capacity of ice making system 160 by altering properties of the water introduced to mold body 200. For example, in one embodiment, method 400 may include the step 420 of activating ice formation heater 382. As described above, ice formation heater 382 may be attached to, integral with, or in close proximity to mold body 200. Upon activation, ice formation heater 382 may transfer heat to water and ice on mold body 200, slowing the rate of ice formation and decreasing the cooling capacity of ice making system 160. In another embodiment, method 400 may include the step 422 of activating a water heater in fluid communication with the water distribution manifold 240 to provide war water to mold body 200. In yet another embodiment, method 400 may include the step 424 of adjusting fluid control valve 388, which is positioned upstream of water distribution manifold 240. In so doing, the flow rate of water to water distribution manifold 240 is reduced, slowing the rate of ice formation.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for making clear ice, comprising the steps of:
detecting a demand for ice;
activating a heat exchanger heater to heat a first refrigerant;
monitoring heat exchanger heater usage data;
activating a pump based on the heat exchanger heater usage data, the pump circulating the first refrigerant through a first sealed refrigerant system to remove heat from an ice holding chamber;
delivering water to a mold body from a water distribution manifold;
detecting that the demand for ice is satisfied; and
deactivating the pump.

2. The method of claim 1, wherein the heat exchanger heater usage data is the length of time that the heater has run.

3. The method of claim 1, wherein the heat exchanger heater usage data is the temperature of the first refrigerant.

4. The method of claim 1, further comprising the step of adjusting the speed of a variable speed compressor for circulating a second refrigerant in a second sealed refrigeration system to remove heat from the first refrigerant.

5. The method of claim 1, wherein the pump is a variable speed pump and the step of activating the pump further includes adjusting the speed of the pump to alter the circulation rate of the first refrigerant.

6. The method of claim 1 further comprising the step of activating an ice formation heater attached to the mold body to reduce the rate of ice formation.

7. The method of claim 1 further comprising the step of activating a water heater in fluid communication with the water distribution manifold to provide warm water to the mold body.

8. The method of claim 1 further comprising the step of adjusting a fluid control valve upstream from the water distribution manifold for controlling the flow of water to the water distribution manifold.

9. The method of claim 4, wherein the step of circulating a second refrigerant in a second sealed refrigeration system further includes circulating the second refrigerant through a heat exchanger.

10. The method of claim 9, wherein the step of circulating the first refrigerant through a first sealed refrigerant system further includes circulating the first refrigerant through the heat exchanger.

11. A method for making clear ice, comprising the steps of:
detecting a demand for ice;
activating a heat exchanger heater to heat a first refrigerant;
monitoring heat exchanger heater usage data;
activating a pump based on the heat exchanger heater usage data, the pump circulating the first refrigerant through a first sealed refrigerant system to remove heat from an ice holding chamber;
circulating a second refrigerant in a second sealed refrigeration system to remove heat from the first refrigerant;
delivering water to a mold body from a water distribution manifold;
detecting that the demand for ice is satisfied; and
deactivating the pump.

12. The method of claim 11, wherein the heat exchanger heater usage data is the length of time that the heater has run.

13. The method of claim 11, wherein the heat exchanger heater usage data is the temperature of the first refrigerant.

14. The method of claim 11, wherein the step of circulating a second refrigerant in a second sealed refrigeration system further includes adjusting the speed of a variable speed compressor.

15. The method of claim 11, wherein the pump is a variable speed pump and the step of activating the pump further includes adjusting the speed of the pump to alter the circulation rate of the first refrigerant.

16. The method of claim 11 further comprising the step of activating an ice formation heater attached to the mold body to reduce the rate of ice formation.

17. The method of claim 11 further comprising the step of activating a water heater in fluid communication with the water distribution manifold to provide warm water to the mold body.

18. The method of claim 11 further comprising the step of adjusting a fluid control valve upstream from the water distribution manifold for controlling the flow of water to the water distribution manifold.

19. The method of claim 14, wherein the step of circulating a second refrigerant in a second sealed refrigeration system further includes circulating the second refrigerant through a heat exchanger.

20. The method of claim 19, wherein the step of circulating the first refrigerant through a first sealed refrigerant system further includes circulating the first refrigerant through the heat exchanger.

* * * * *